United States Patent [19]

Wang

[11] Patent Number: 4,479,370

[45] Date of Patent: Oct. 30, 1984

[54] FULL COUNTERFLOW MINI-BATH OPEN-WIDTH FABRIC WASHER

[75] Inventor: Kenneth Y. Wang, Greensboro, N.C.

[73] Assignee: Burlington Industries, Inc., Greensboro, N.C.

[21] Appl. No.: 329,594

[22] Filed: Dec. 10, 1981

[51] Int. Cl.[3] ..... D06B 3/12; D06B 15/02

[52] U.S. Cl. ..... 68/22 R; 68/181 R

[58] Field of Search ..... 8/151; 68/181 R, 175, 68/22 R, 27, 9, 184

[56] References Cited

U.S. PATENT DOCUMENTS

| | | | |
|---|---|---|---|
| 813,478 | 2/1906 | Zillessen | 68/9 X |
| 1,209,465 | 12/1916 | Matter | 68/22 R X |
| 1,577,393 | 3/1926 | Voegeli | 8/151 X |
| 1,741,338 | 12/1929 | Rowley et al. | 68/181 R X |
| 2,487,197 | 11/1949 | Stott et al. | 8/151 X |
| 4,160,297 | 7/1979 | Davis | 68/181 R X |

FOREIGN PATENT DOCUMENTS

| | | | |
|---|---|---|---|
| 531478 | 9/1954 | Belgium | 68/181 R |
| 235256 | 2/1910 | Fed. Rep. of Germany | 68/181 R |
| 314721 | 10/1919 | Fed. Rep. of Germany | 68/9 |
| 2518770 | 11/1976 | Fed. Rep. of Germany | 68/181 R |

*Primary Examiner*—Philip R. Coe

*Attorney, Agent, or Firm*—Cushman, Darby & Cushman

[57] ABSTRACT

An apparatus for contacting a continuously moving textile material with a liquid comprises an enclosure, a plurality of upper and lower rolls located in the enclosure and being generally vertically arranged and horizontally spaced therein to upwardly and downwardly guide the textile material therethrough, a plurality of tank means located in the enclosure for containing a volume of liquid wherein the tanks are positioned in ascending arrangement so that the liquid cascades from one tank to the next to effect counterflow relative to the general path of conveyance of the textile material through the enclosure. A method utilizing the apparatus is also disclosed.

16 Claims, 1 Drawing Figure

FULL COUNTERFLOW MINI-BATH OPEN-WIDTH FABRIC WASHER

BACKGROUND OF THE PRESENT INVENTION

The present invention generally relates to an apparatus for contacting a continuously moving textile material with liquid. More specifically, the present invention relates to an efficient full counterflow mini-bath open width fabric washer utilized following the processing of textile material when such textile material has been contacted, for example, by neutralizing, dyeing, bleaching or other liquid treatment baths.

Conventional apparatuses have been proposed which utilize counterflow techniques for liquid movement relative to the general path of conveyance of textile material, such as, for example, those disclosed in U.S. Pat. Nos. 1,037,280; 2,736,183; and 3,765,195. Additionally, U.S. Pat. No. 2,764,010 discloses a conventional apparatus which utilizes narrow channels for the introduction of a treating liquid. The channels or wells are provided such that the fluid is forced from one well to another, at least substantially, by the movement of the fabric therethrough. U.S. Pat. Nos. 4,182,140 and 4,150,449 disclose apparatuses which utilize cascade trays and elements for fluttering or stretching the fabric to facilitate the removal of the liquid therefrom. Additionally, U.S. Pat. Nos. 4,182,141 and 3,927,971 disclose apparatuses for continuously treating a cloth material with liquid while the cloth material is not under tension within the apparatus.

The present invention is generally related to the first group of conventional apparatuses as disclosed by U.S. Pat. Nos. 1,037,280; 2,736,183; and 3,765,195, in that a counterflow method of contacting the textile material with a liquid is utilized. While the general concept of treating a textile material with a counter flowing liquid relative to the general path of conveyance of the textile material is known, problems have been associated when utilizing the conventional apparatuses. More specifically, there is a possibility when utilizing the conventional apparatuses that stratification or concentration of impurities within the individual tanks may occur. The counterflow method or concept utilizes the principle that the textile material when in its most contaminated and/or treated state enters the most contaminated liquid first, and is successively treated with less contaminated liquid as the textile material moves through the apparatus. Thus, the "cleanest" liquid is contained in the tank closest to the output end of the apparatus where the textile is also the cleanest or freest of impurities, while the "dirtiest" liquid is contained in the tank nearest the input end of the apparatus. The terms "clean" and "dirty", and variations thereof, are intended to refer to low and high gradations, respectively, of treating materials, impurities or the like.

While the textile material moves through the apparatus, impurities which may exist in the textile material are washed therefrom by contacting the textile material with the liquid contained in the individual tanks. With a conventional apparatus, as discussed above, there is a possibility that stratification of these impurities may result in the lower portion of the individual tanks, especially in the bottom corners of the tanks, such that the concentration gradient between the textile material and the liquid contained in the tank will be decreased and thereby defeat the overall principle of utilizing the counterflow method.

Additionally, there are spatial limitations which may occur in a conventional apparatus. These spatial limitations are generally defined by the amount of counterflow necessary to effect proper treatment of the textile material within the enclosure. A high quality textile material, for example, which must be thoroughly cleaned so as to be substantially free from impurities present due to earlier processing, will need to be contacted by several succeeding conventional apparatuses in horizontal arrangement in order to be adequately treated. The horizontal arrangement of a plurality of conventional apparatuses necessarily increases the amount of floor area needed within a textile mill. Thus, conservation of valuable and important floor space within a textile mill may not be realized when utilizing a conventional apparatus.

According to the present invention, however, there is provided an apparatus and method whereby the stratification of treating materials, impurities or sediment is significantly minimized or eliminated. Furthermore, spatial limitations and other factors, as discussed below, are optimized to a degree that any quality of textile materials may be treated without wasting floor space.

SUMMARY OF THE PRESENT INVENTION

The apparatus by which the above objectives are accomplished generally comprises a series of small tanks each holding a limited volume of liquid. A wash roll may be located in each tank to force liquid through the fabric to remove contaminants contained therein. The small volume of liquid is crucial for effective treatment; since the entire volume of liquid is small and well agitated it can be exchanged quickly thereby preventing stratification or localized concentration levels in the tanks. However, sufficient clearance is provided between the wash rolls and the tank walls for cleaning and thread-up of the fabric.

The configuration of the small tanks is such that each tank is located at a slightly higher level from the preceding tank to encourage the water to overflow from one side of the higher tank by gravity into the next lower tank. Since there are no connecting pipes, delivery pumps, or filters between the tanks, the potential for clogging whether by impurities, lint, or other forms of sediment is eliminated with the beneficial effect of reducing potential maintenance problems.

There are many types of apparatus for continuously contacting a textile material in the open form with water. In recent years new washers have been commercialized with the objective of energy and water conservation. However, conventional apparatus is still not satisfactory to meet all the various stringent demands of textile wet processing needs. The following considerations are all important in textile wet processing:

- energy conservation;
- water conservation;
- floor space savings;
- simplicity of components;
- ease of maintenance and cleaning;
- compatibility with automatic process control equipment;
- control of fabric tension and control of fabric sagging at the center; and
- control of fabric creasing.

Input variables which may affect the output responses of the above considerations include the relationship between washing efficiency and dipping rolls, roll configuration, number of rolls, roll diameter, water flow rate, fresh water addition technique, water temperature, impurities concentration, counterflow, water flow pattern, water bath design, fabric speed, fabric weight, fabric contamination, fabric tension, fiber content, yarn twist, yarn size, or the like.

According to the present invention, there is provided an apparatus which successfully meets all the considerations mentioned above. In addition, the apparatus according to the present invention is of maximum simplicity for ease of control and servicing, which necessarily results in overall reduced capital costs. The apparatus according to the present invention should not cause the fabric to experience excessive tension or the undesirable tendency to form bulges, creases or unwanted wrinkles which often result in nonuniform washing.

Additionally, the relatively small size of the tanks according to the present invention and the contoured shape thereof permit a high degree of control to be exercised over the concentration of the liquid contained within each tank. The water or liquid in each tank is well agitated by virtue of the small tank size and the contoured fitting of the wash rolls, which tends to minimize stratification or "dead spots". Thus, the overall advantage of utilizing the tanks and the apparatus according to the present invention is that the use of and control over each gallon of liquid are optimized.

An additional advantage of using the apparatus according to the present invention is that there is provided an apparatus whereby the entire liquid circuit or flow path may be monitored and controlled. By virtue of the completeness of control of the counterflow pattern, the well agitated state of the liquid and the decreased total volume of liquid, the system reaches equilibrium concentration in a relatively short period of time. Parameters such as temperature, concentration and viscosity can be monitored and more easily controlled since an equilibrium reading can be obtained in a minimum of time. Since most conventional electronic monitoring instruments have very short response times, the washing variables can be monitored and controlled with greater precision resulting in shorter elapsed time and smaller amplitude of response. Therefore, the hysteresis of the system is significantly minimized and exhibits more constant control parameters.

The apparatus according to the present invention is intended to be acceptable for continuously washing, desizing, or otherwise suitably treating an open width of textile material with liquid after operations, such as dyeing, bleaching or the like. The textile material which may be satisfactorily utilized by the present invention may exhibit varying porosities. It is also conceivable that when a very open weave type of fabric is treated, multiple layers may be processed simultaneously with satisfactory results. Additionally, several narrow strips or webs of fabric material may be processed simultaneously by placing them side by side and guiding them through the apparatus so that they contact the liquid contained therein.

Other advantages and objects of the invention will become more readily apparent to the reader from the detailed discussion of the invention below.

Figure 1:
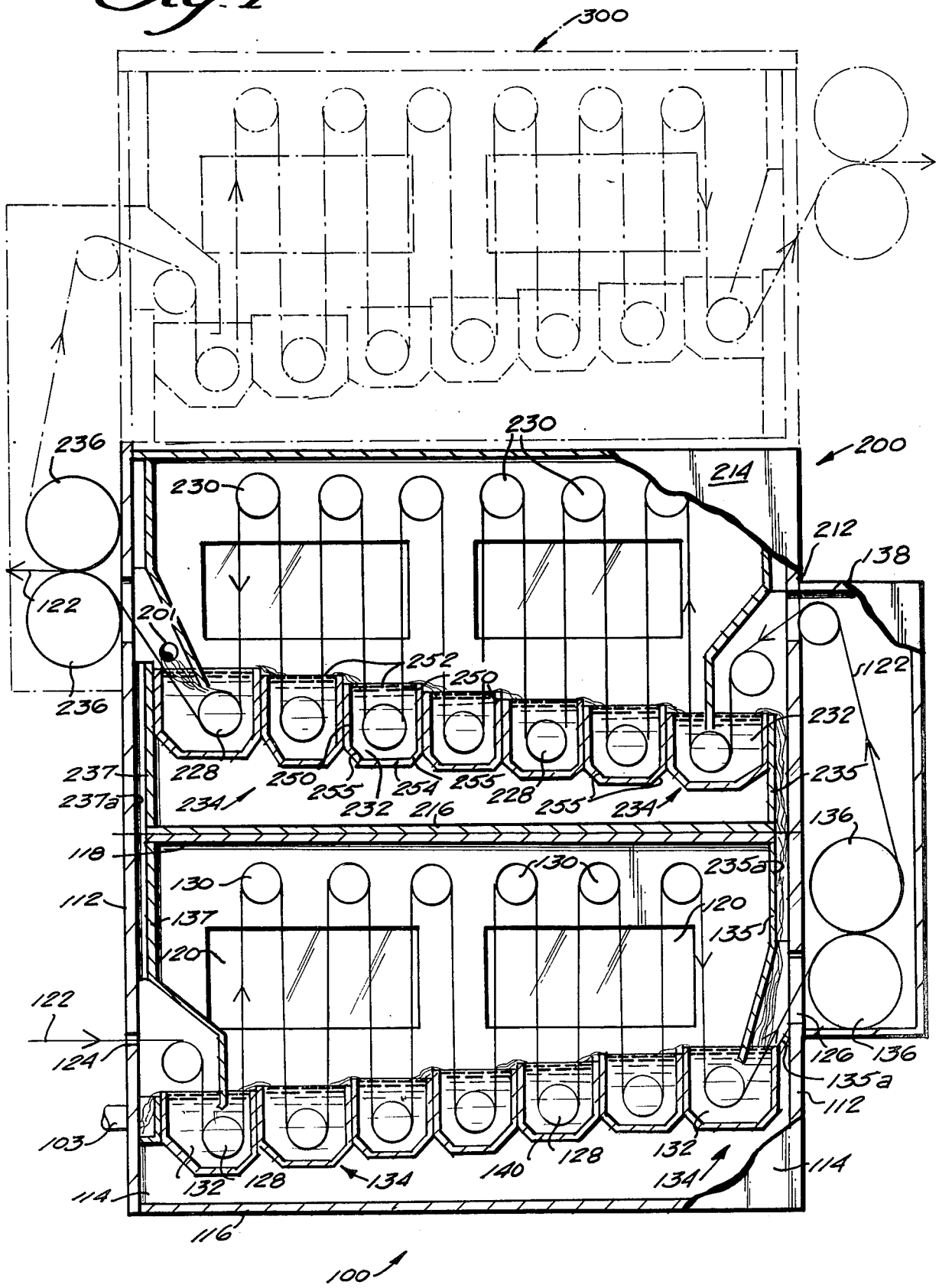
FIG. 1 is a cross-sectional elevational view of a preferred exemplary embodiment of the full counterflow apparatus according to the present invention.

DETAILED DESCRIPTION OF THE PREFERRED EXEMPLARY EMBODIMENT OF THE PRESENT INVENTION

Reference herein is made to FIG. 1 wherein a cross-sectional elevational view of the preferred embodiment of a full counterflow apparatus is depicted and wherein like numerals refer to corresponding structures throughout. The solid lines appearing in FIG. 1 indicate the preferred embodiment of the present invention, while the dashed lines indicate a possible modification thereto as will be more fully explained below.

Referring now to FIG. 1, wherein a lower unit 100 and an upper unit 200 of a full counterflow apparatus are shown in a vertically stacked arrangement, it is readily apparent that the units 100 and 200 are similar but are vertically juxtaposed in an opposite manner.

The lower unit 100 will be discussed fully below; however, the reader should appreciate that the discussion which follows is generally also applicable to the upper unit 200.

The lower unit 100 is generally comprised of two sets of opposing side walls 112 and 114, a bottom wall 116, and a top wall 118 which together form an enclosed housing. All of the walls may be constructed from a durable material, such as, for example, heavy gauge steel or the like. Additionally, windows 120 constructed of a transparent material, such as, for example, glass, heavy plastic, or the like are preferably provided in predetermined walls so that an operator may visually inspect the interior operation of the unit.

The two pairs of opposing side walls, 112 and 114, and the bottom and top walls, 116 and 118, respectively, may be provided with an insulating material, excluding the windows 120, so that heat losses from the unit to the ambient environment may be minimized. Additionally, the vertical arrangement of a plurality of units provides for a decrease in the overall heat transfer coefficient thereby providing further insulating capacity.

The textile material 122 enters the unit 100 through an opening 124 provided in one of the opposite side walls 112. Similarly, the textile material 122 exits the unit 100 through an additional opening 126 provided in the other directly opposite side wall 112.

After the textile material 122 enters unit 100 it is sequentially directed in an upward and downward fashion by being threaded around a plurality of upper and lower rolls 128 and 130, respectively, located in the enclosure. The upper and lower rolls 128 and 130, respectively, extend across the width of the enclosure and are rotatably supported between sidewalls 114. They are arranged with the upper and lower sets being staggered horizontally so that the textile material 122 after leaving one of the lower rolls 128 will proceed substantially vertically upwardly to the next corresponding upper roll 130 and thereafter will be directed substantially vertically downwardly toward the next succeeding lower roll 128 and so on. The lower rolls 128 are positioned in each tank 134 such that the textile material 122 will be contacted with the liquid 132 contained in each particular tank with which that lower roll 128 is associated.

The liquid 132 may enter the unit by any conventional method, including, for example, by a pipe 201 located in the uppermost unit 200 and having a sufficient diameter to accommodate necessary flow rates. Similarly, the liquid may exit unit 100 by any convenient means; for example, it can be transported to a predetermined location by a pipe 103. Of course, when a vertically stacked arrangement of units 200 and 100 is utilized, the upper unit 200 will be provided with the liquid inlet pipe 201 while the lower unit will be provided with the liquid exit pipe 103. The liquid inlet and exit pipes should be sized to permit a flow rate of about 5 to about 60 gallons of liquid per minute, preferably about 20 to about 40 gallons of liquid per minute. The flow rate of liquid into the unit 100 will generally be equal to the flow rate of the liquid therefrom and will additionally equal the flow rate of the cascading liquid between the tanks. The temperature should be elevated to enhance the effect of the liquid upon the textile material. Preferably, the temperature of the liquid 132 should be in the range between about 150° F. to about 210° F.

The textile material 122 may be conveyed through the unit 100 by utilizing various combinations of driven lower and upper rolls, 128 and 130, respectively, as the conveying mechanism. All or selected ones of the lower rolls 128 may be coupled to a suitable driving device, such as, for example, an electric motor or the like and drive belts (not shown) in a conventional fashion, so that a rotational movement is translated thereto. Similarly, all or selected ones of the upper rolls may be drivenly coupled to a suitable driving apparatus capable of imparting a rotational movement thereto. The amount of force required to drive a given textile material through the unit 100 is dependent upon several factors including the weight of the material to be conveyed, the porosity of the material, the surface frictional properties of the textile material, the desired tension to be maintained upon the textile material, or the like.

Therefore, any combination of driven lower and upper rolls, 128 and 130, respectively may be utilized to obtain the particular driving force or rate of conveyance through the unit 100 as may be desired for any given fabric or fabric construction. Additionally, nip rolls 136 are preferably driven as well, with the positive rotation provided thereby being utilized either as the sole driving force to convey the textile material through the unit 100, or in conjunction with the variety of driven combinations of lower and upper rolls, 128 and 130, respectively, mentioned above.

The textile material should be conveyed at a rate of less than about 150 yards per minute, preferably at a rate varying between about 80 to about 150 yards per minute. Additionally the tension to be maintained upon the textile material during processing should preferably be less than about 30 pounds force per foot of width of textile material.

As described above, the textile material 122 sequentially moves in an upward and downward fashion as it moves around the upper and lower rolls, 128 and 130, respectively, and may, for example, exit unit 100 after contacting the last successive lower roll 128. The textile material 134 is then preferably directed to a pair of driven nip or squeeze rolls 136 wherein the nip or squeeze pressure can be pneumatically adjusted in a conventional fashion so that as the textile material 122 is conveyed therebetween, the fabric can be conveyed and excess liquid squeezed therefrom. An enclosure 138 is provided as a housing for nip rolls 136 and can be fixedly attached on the exterior side walls of units 100 and 200. In such a manner, any residual liquid 132 squeezed from the textile material 122 by the nip rolls 136 may be captured in the enclosure 138 and directed back into the tanks 134 through the opening 126.

The counterflow textile washer is generally comprised of a plurality of small tanks 134 which are individually arranged in ascending order in the general path of conveyance of the textile material 122. This arrangement in ascending order allows cascading of the liquid from one tank 134 to the next descending tank 134 thereby effecting counterflow of that treating liquid relative to the path of conveyance of the textile material 122. Further, the bottom wall 140 of the tanks is generally contoured to the shape of the lower roll 128 located therein.

The contoured shape of the bottom wall 140 of each tank 134 is a very important feature of the present invention as will be discussed in more detail below. Thus, as the textile material 122 is upwardly and downwardly guided through the lower unit 100, it will be contacted with progressively cleaner liquid 132.

The textile material 124 after being treated and washed in the lower unit 100 is conveyed to a like upper unit 200, which preferably is stacked in vertical arrangement with the treating tanks or compartments again arranged in an ascending order as in unit 100.

In a similar fashion as in unit 100, the textile material 122 is directed first into the lowest tank 234 located in the upper unit 200. The textile material 122 is contacted with treating liquid in the upper unit and is thereafter guided upwardly and downwardly in a sequential fashion by sets of generally vertically arranged and horizontally spaced upper and lower guide rolls, 230 and 228, respectively through the upper unit 200. The textile material 122 is thus treated by the liquid 232 contained in each individual tank 234 in upper unit 200 in a manner similar to that described for lower unit 100.

The vertical arrangement of the lower and upper units, 100 and 200, respectively, not only provides a relatively long treatment path in a relatively confined area, but it also allows the textile material to remain within the treating environment as it moves beween treating chambers. Further, the heat and environment developed in the lower unit 100 can be used to effectively establish suitable treating conditions in the upper unit 200 thereby saving energy. The liquid which cascades from the effluent tank 234 in unit 200 is directed to unit 100 and the influent tank 134 therein by upper and lower baffles 235, 135 respectively associated with units 200, 100. Baffles 235 and 135 together define channel **235*a* which extends from generally the liquid in-let tank 134 in unit 100 through the top and bottom walls 118,216 of units 100, 200, respectively, and by a suppelmental baffle 135*a* which extends between the interior of sidewall 112 below opening 126 and the side of the inlet tank 134 in unit 100**.

After leaving the last tank in the upper unit the textile material may be directed between nip rolls 236 similar to those used in the lower unit, whereby residual liquid 232 is squeezed from the textile material. This liquid is either reintroduced into unit 200, directed back into unit 100 by additional baffles 237, 137 or conveyed via suitable piping (not shown) to a reservoir or supply tank, or to a drain. Baffles 237, 137 together define channel **237*a* which extends from influent 234 of unit 200 to effluent tank 134 of unit 100 through the top and bottom walls 118, 216 of units 100, 200**, repsectively.

It will be appreciated that if further washing or contact with the treating liquid is required, one or more additional units such as shown in phantom at 300 may be vertically stacked above the upper unit 200 in an opposite manner thereto. The vertical arrangement of units as disclosed herein has several beneficial features. First, the path of conveyance of the textile material is optimized within the two tier system thereby reducing friction loss and saving energy necessary to convey the textile material. Second, floor space is minimized by the vertical stacking so that a textile material may be sufficiently washed or contacted with a liquid to a desired degree without utilizing a large amount of valuable floor space in a textile mill. Third, the vertical arrangement inherently provides for thermal efficiencies as appreciated by the fact that there will be little or no temperature gradient between the top wall of one unit and the bottom wall of the unit stacked above it in vertical arrangement. Therefore, thermal efficiency is necessarily increased since the area over which heat losses may occur is minimized due to the vertically stacked arrangement. Additionally, the vertical arrangement encourages gravitational flow from one unit to the next without the use of transfer pumps or the like, thereby saving energy and high maintenance cost which would be necessary to operate such equipment. In addition, insulating material is provided on all walls of the enclosure, with the exception of the windows.

THE LIQUID HOLDING TANKS

Reference will now be made to the tanks associated with each of the units in this washing or treating system.

Each individual tank 234 (or 134) is an important feature of the present invention. Employed collectively they allow the use and effect of water or treating liquid to be optimized for a given volume of liquid. Each tank generally comprises an opposing set of vertically extending sidewalls 250 and endwalls 252, a substantially horizontal bottom wall 254 and a pair of angled walls 255 joining the bottom of the sidewalls 250 to the bottom wall 254. Preferably, angled walls 255 form an obtuse angle relative to sidewalls 250 and bottom wall 254. Walls 250, 252, 254 and 255 together form an open "trough" that will allow liquid 232 to closely fill around rollers 228. Bottom wall 254 and angled walls 255 are provided such that they closely contour the bottom of the tank to the general shape of the cylindrical rolls. It will be appreciated that as the textile material moves through each tank 234 and is contacted with the liquid therein there will be no idle or unused volume of liquid thereby providing no concentration or stratification of treating liquid or of contaminants. Thus, impurities removed from the textile material which necessarily contaminate the liquid contained in the tanks are continuously discharged toward the lowermost tank in the system due to the continuous introduction of less contaminated liquid into the tank. The constant mixing of the liquid in the tank 234 provides a relatively constant concentration gradient of the liquid in any given tank making treatment much more uniform and more controllable.

Because of the ascending arrangement of the tanks, and the cascading flow from one tank to the next lower tank, counterflow of liquid is established relative to the general path of conveyance of the textile material. The tank nearest the textile output end of the system necessarily contains the "cleanest" liquid (i.e., the liquid with the lowest concentration of impurity), while the tank nearest the textile input end of the system contains the "dirtiest" liquid (i.e., the liquid with the highest concentration of impurities). The concentration of impurities in the tanks positioned between these two necessarily falls as the fabric moves from each tank to the one next above it.

To facilitate the proper washing of the textile material 122, each tank 234 is provided with contoured bottom walls 254 and 255 such that the side walls 250 of the tank 234 do not create a right angle with bottom wall 254. The purpose of the contour shape is to prevent stratification of the impurities contained in the liquid or of the treating liquid itself which might otherwise occur at points of low agitation. The prevention of stratification of treating liquid, impurities or sediment is very important to effectively wash or otherwise treat textile material with liquid contained in each tank 234. Due to the contoured shape of the bottom wall 254, the liquid in each tank is constantly agitated thereby preventing the stratification mentioned above. Additionally, the overall small volume of the liquid 232 contained in each tank 234 further inhibits stratification and enhances not only proper agitation of the liquid within tanks 234 but allows more precise control over treatment conditions.

The lower rolls 228 are preferably positioned within each tank 234 so as to be submerged in the treating liquid with the textile material guided around them also being below the surface of the liquid in each tank. However, rolls 228 can be situated or placed in the tanks 234 in any convenient manner as long as the textile material 122 properly contacts the liquid 232 in tanks 234.

It will be appreciated that the closer the rolls 228 are situated toward the bottom wall 254 of the tank 234, the better the mixing of the liquid due to the movement of the textile material 122 through the liquid 232 contained therein. The only limiting factor on the lowest placement of the rolls 228 is the ease with which these may be threaded, i.e., the textile material 122 be placed around the lower rolls 228 prior to operation. Preferably, the space between the bottom wall 254 of the tank 234 and the closest surface of the lower roll 228 is in the range of about 0.5 inches to about 2 inches. However, this spatial limitation is only for the convenience of the operator of the unit in threading the lower rolls 228 prior to start-up and, conceivably, any variations therebetween will not adversely affect the operation of the unit.

While the embodiment of the present invention is depicted in FIG. 1 as comprising two units, it will be appreciated that a plurality of units may be utilized and can be vertically stacked in such a manner that any desired amount of washing or other treating with a given volume of liquid may be effected. The only limitations on the number of units which may be employed to contact the textile material with a liquid are the equipment costs, energy costs, the quality of the finished product, the specific liquid employed, or the like.

The method according to the present invention generally comprises the steps of:

(a) conveying a textile material continuously under tension in an upward and downward path through the enclosure;

(b) contacting the textile material with a liquid contained in the tanks so that the textile material communicates with successively less contaminated liquid as it is conveyed through the enclosure;

(c) removing residual cleaning liquid from the textile material;

(d) transferring the textile material to an additional unit stacked in vertical arrangement; and (e) repeating steps (a) through (d) until the textile material is sufficiently treated to a predetermined quality.

More particularly, the method contemplates that prior to conveying the textile material through the apparatus, the following steps are employed:

(i) introducing the textile material into the apparatus;

(ii) threading the textile material for conveyance through the apparatus;

(iii) setting the desired nip roll tension;

(iv) preparing and introducing the desired treating liquid; and (v) controlling a limited volume of liquid in each one of a plurality of tanks.

While the invention has been herein described in what is presently conceived to be the most practical and preferred embodiment, it will be apparent to those of ordinary skill in the art that many modifications may be made within the scope of this invention, which scope is to be accorded the broadest interpretation of the appended claims so as to encompass all equivalent assemblies, structures and methods.

What I claim is:

1. Apparatus for treating a continuously moving textile material with a liquid comprising at least two units stacked in a vertical arrangement so that said textile material will pass through each unit in ascending order and the effluent treating liquid of a superiorly stacked unit will gravitationally flow into the influent side of an immediately lower stacked unit, the most superior unit characterized as including inlet means for introducing liquid at a predetermined rate of flow into the influent side of said superior unit and the most inferior unit characterized as including outlet means for transferring liquid at a predetermined rate of flow from the effluent side of said inferior unit to a predetermined location, each of said units comprising:

an enclosure including a pair of opposing end walls, a pair of opposing side walls, a bottom wall and a top wall, wherein a first one of said pair of opposing end walls includes means defining at least one inlet for allowing input of said textile material therethrough and the other of said pair of opposing end walls includes means defining at least one exit for allowing output of said textile material therethrough;

a plurality of upper and lower rolls rotatably mounted within said enclosure in a staggered arrangement so that they are vertically and horizontally spaced from one another;

a plurality of separate tank means located in said enclosure for containing a volume of liquid therein, said tank means being positioned in an ascending arrangement between influent and effluent tank means so that the liquid cascades from each of said tank means to the next tank means in descending order to effect counter flow of the liquid relative to the general path of conveyance of said textile material through said enclosure, each tank means including contouring means for contouring the shape of said tank means to the general shape of said lower rolls and for effecting constant agitation of said liquid contained therein by virtue of said textile material being conveyed therethrough to provide a relatively constant concentration gradient for said liquid;

conveying means for conveying said textile material through said unit;

mounting means for mounting said unit in opposite vertical arrangement with other similar units;

squeezing means exteriorly located on the textile material output end of said enclosure for squeezing residual liquid from said textile material, said squeezing means including a pair of nip roll means to accept said textile material therebetween and to forcibly remove residual liquid therefrom; and baffle means for directing the effluent liquid of a superiorly stacked unit to the influent side of the interior portion of the enclosure of the adjacent inferior unit and for directing the residual liquid removed from said textile material by the nip roll means of a superiorly stacked unit to the effluent side of the interior portion of the adjacent inferior unit, said baffle means including first and second upper baffle members and first and second lower baffle members, said first upper baffle member (i) rigidly fixed with respect to said first one of said pair of end walls and defining therewith a first upper channel, (ii) said first upper channel in communication with a first opening formed in said top wall, and (iii) extending from said first top wall opening to said influent tank means, said second upper baffle member, (i) rigidly fixed with respect to said other of said pair of end walls and defining therewith a second upper channel, (ii) said second upper channel in communication with a second opening formed in said top wall, and (iii) extending from said second top wall opening to said effluent tank means, said first lower baffle member, (i) rigidly fixed between said influent tank means and said first one of said pair of end walls and defining with said first one end wall a first lower channel, (ii) said first lower channel in communication with a third opening formed in said bottom wall and registered with said second opening of said top wall of the adjacent inferior unit, and (iii) extending from a point below said textile material outlet to said third opening, said second lower baffle member, (i) rigidly fixed between said effluent tank means and said other of said pair of end walls and defining with said other end wall a second lower channel, (ii) said second lower channel in communication with a fourth opening formed in said bottom wall and registered with said first opening of said top wall of the adjacent inferior unit, and (iii) extending from a point below said textile material inlet to said fourth opening, whereby liquid gravitationally flows from said effluent tank means of a superiorly stacked unit to the influent tank means of an adjacent inferiorly stacked unit by virtue of the communication established therebetween by said second lower channel of said superiorly stacked unit and said first upper channel of said adjacent inferiorly stacked unit while said residual liquid removed from said nip roll means associated with said superiorly stacked unit gravitationally flows to said effluent tank means of said adjacent inferiorly stacked unit by virtue of the communication established therebetween by said first lower channel of said superiorly stacked unit and said second upper channel of said adjacent inferiorly stacked unit.

2. An apparatus as in claim 1 wherein said contouring means comprise a generally horizontal planar structure, and first and second opposite planar structures fixedly attached to said horizontal planar structure and corresponding said first opposing side walls so that the angular relationship between said first and second opposing structures and first opposite side walls is an obtuse angle.

3. An apparatus as in claim 1 wherein said nip roll means include means for conveying said textile material through said enclosure so that adequate tension is maintained thereon.

4. An apparatus as in claim 1 wherein at least one of said second opposite side walls includes at least one window.

5. An apparatus as in claim 1 wherein said end walls, side walls, bottom wall and top wall are provided with insulating material.

6. An apparatus as in claim 1 wherein said upper and lower rolls include means to rotate predetermined ones of said rolls so that said textile material is drivenly conveyed through said enclosure so that adequate tension is maintained thereon.

7. An apparatus as in claim 6 wherein said upper rolls or said lower rolls include means to rotate predetermined ones of said rolls so that said textile material is drivenly conveyed through said enclosure so that adequate tension is maintained thereon.

8. An apparatus as in claim 6 wherein the tension on said textile material is less than about 30 pounds force per foot of width of said textile material.

9. An apparatus as in claim 1 wherein said textile material moves through said enclosure at a rate between about 80 to about 150 yards per minute.

10. An apparatus as in claims 1 or 9 wherein said textile material moves through said enclosure at a rate less than about 150 yards per minute.

11. An apparatus as in claim 1 wherein the flow rate of said cascading liquid is between about 20 to about 40 gallons per minute.

12. An apparatus as in claim 1 wherein the flow rate of said cascading liquid is between about 5 to about 60 gallons per minute.

13. An apparatus as in claim 1 wherein the flow rate of said cascading liquid is between about 5 to about 10 gallons per minute.

14. An apparatus as in claim 1 wherein said liquid is between about 150° F. to about 210° F.

15. An apparatus as in claim 1 wherein said liquid comprises water.

16. An apparatus as in claim 1 wherein about seven tank means are provided.

* * * * *